United States Patent [19]

Graves

[11] 4,272,925

[45] Jun. 16, 1981

[54] SHARPENING APPARATUS

[75] Inventor: Louis N. Graves, Anoka, Minn.

[73] Assignee: Louis N. Graves Co., Inc., Anoka, Minn.

[21] Appl. No.: 117,876

[22] Filed: Feb. 4, 1980

[51] Int. Cl.[3] ..... B24B 3/54; B24D 15/02

[52] U.S. Cl. ..... 51/211 R

[58] Field of Search ..... 51/204, 211 R, 212, 51/214; 76/82.2, 86

[56] References Cited

U.S. PATENT DOCUMENTS

| | | | |
|---|---|---|---|
| 462,001 | 10/1891 | Foster | 76/86 |
| 3,623,280 | 11/1971 | Chesnut | 51/211 R X |
| 4,228,703 | 10/1980 | Moss | 76/82.2 X |
| 4,231,194 | 11/1980 | Glesser | 51/211 R |

*Primary Examiner*—Gary L. Smith

*Attorney, Agent, or Firm*—Burd, Bartz & Gutenkauf

[57] ABSTRACT

A sharpening apparatus includes a base and a pair of thin elongated cylindrical sharpening rods of the type that can be made of a ceramic material which is loaded with a strong abrasive. The rods are storable in a compartment provided by the base in side-by-side relationship and in such position are accesible for sharpening of a pointed object such as a hunting arrowhead or a dart. The rods are movable to a second position with respect to the base still in side-by-side relationship but with ends extended beyond the base for the sharpening of the ends of objects having a more complicated configuration such as fishing hooks. The rods are mountable in a third position with respect to the base in which they are held in the base in adjacent angular relationship with each other and in acute relationship to the base. In this position the rods can be used to sharpen objects such as knife blades.

11 Claims, 9 Drawing Figures

SHARPENING APPARATUS

SUMMARY OF THE INVENTION

The invention pertains to a sharpening apparatus that is readily portable and can be used to sharpen such diverse objects as hunting arrowheads, fish hooks and knife blades such as the blade of a fish filleting knife whereby the sharpening apparatus is particularly useful to sportsmen such as hunters, fishermen, and campers.

The sharpening apparatus includes a pair of thin, elongate cylindrical sharpening rods that can be made of a ceramic material loaded with a strong abrasive. The apparatus includes a base for holding the rods. The base has a compartment or bed for holding the rods in a first position of side-by-side relationship closely adjacent one another and preferably in side wall contact. In this position, a pointed object such as a dart or a hunting arrowhead can be sharpened by drawing the part to be sharpened along the side wall interface of the two rods. A resilient clip is functional to hold the rods in the first position and is also functional to hold the rods in a second position, again in side-by-side relationship but with ends extending beyond the base whereby a pointed object of a more complicated configuration can be sharpened. With the rod ends extended beyond the base, the object being sharpened can be manipulated to a greater degree as it is being sharpened without encountering interference from the base. The resiliant clip is also functional to hang the base from the belt of user when the apparatus is not in use.

The rods can be mounted in a third position with respect to the base. The base provides mounting means such that the rods can be mounted in angular relationship relative to one another extending upwardly with respect to the base at an acute angle relative to the base. In this position, a knife blade can be sharpened as is taught by U.S. Pat. No. 3,894,362 issued July 15, 1975 to Graves wherein the knife blade is sharpened by drawing the knife down against one or the other of the sharpening rods, at the same time moving the blade longitudinally to move the point of contact of the blade with the rod progressively from the handle towards the tip of the blade while holding the base in horizontal position.

IN THE DRAWINGS

DESCRIPTION OF A PREFERRED EMBODIMENT

Figure 1:
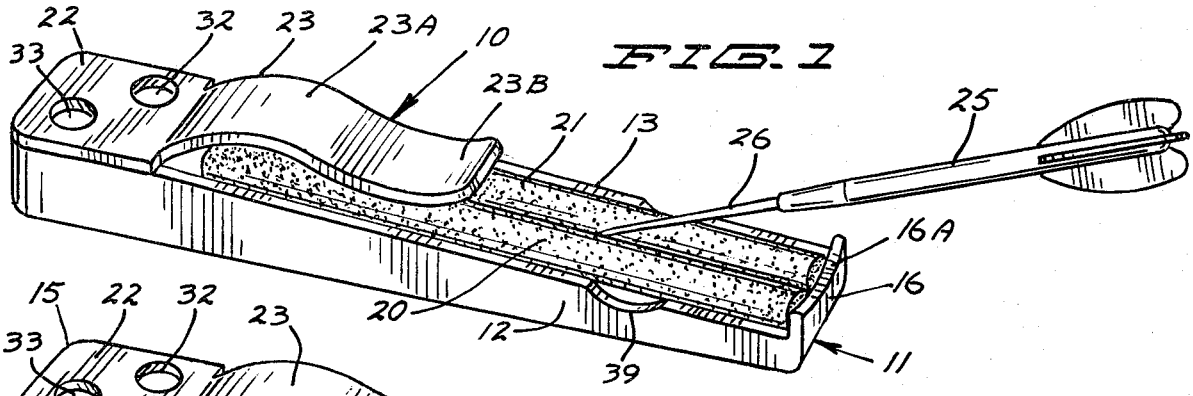
FIG. 1 is a perspective view of a sharpening apparatus according to the invention with the sharpening rods in a first position of storage with respect to the base and with a pointed object positioned with respect thereto for purposes of being sharpened.

Referring to the drawings, there is shown in FIG. 1 a sharpening apparatus according to the invention indicated generally at 10. Sharpening apparatus 10 has a generally rectangular housing or base 11 comprised of sidewalls 12, 13 joined to back wall 15 and a front wall 16. A top wall 22 spans rear horizontal upper edge portions of sidewalls 12, 13 and back wall 15. Upper edges of the sidewalls 12, 13 slope gently downward from top wall 22 toward the front wall 16. The upper edge of front wall 16 is raised above the adjacent terminal portions of the edges of sidewalls 12 and 13.

Figure 4:
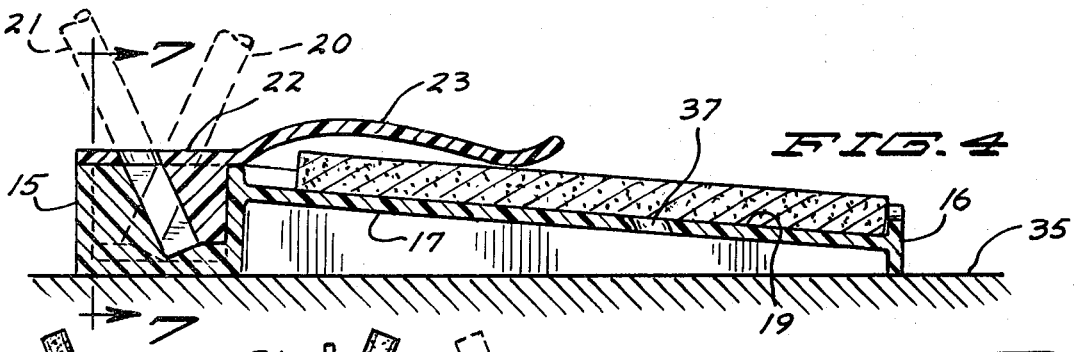
FIG. 4 is a sectional view of the sharpening apparatus of FIG. 3 taken along the line 4—4 thereof.
Figure 5:
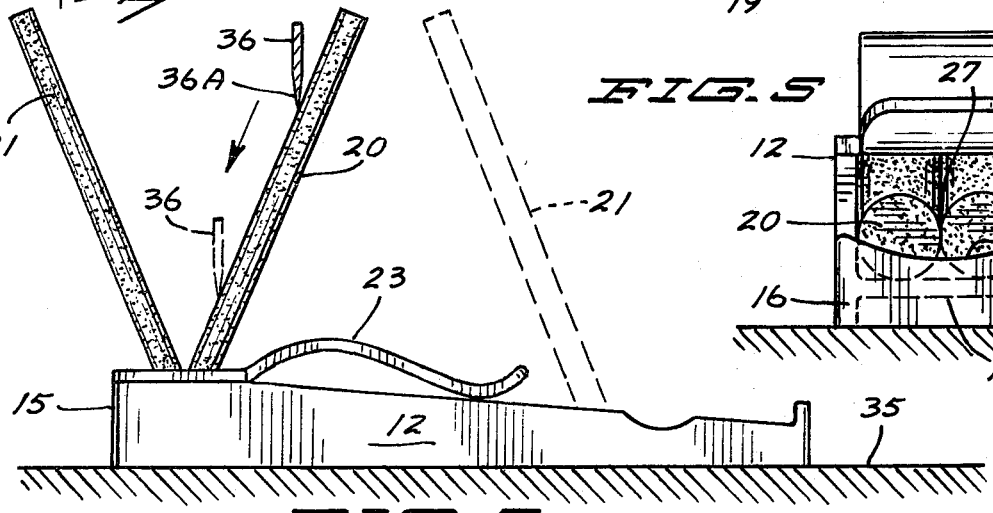
FIG. 5 is an enlarged front end view of the sharpening apparatus of FIG. 1.

A support wall or platform 17 is located in base 11 bounded by sidewalls 12, 13 (see FIG. 4) extending from a location near top wall 22 to a location adjacent front wall 16. Support platform 17 can be fastened to the sidewalls 12, 13, a front wall 16 or, as indicated in FIG. 4, the entire base 15 can be molded of plastic or suitable material whereby platform 17 is integral with sidewalls 12, 13 and front wall 16. Platform 17 is generally horizontal but slopes gently downward from an interior transverse wall 18 near top wall 22 toward the front wall 16. Platform 17 is recessed relative to the upper edges of the sidewalls 12, and 13 and relative to the upper edge of the front wall 16 thus to form an upwardly open pocket or compartment 19.

Platform 17 provides a support surface for a pair of sharpening rods 20, 21. In the configuration or operational mold of FIG. 1, sharpening rods 20, 21 are situated in parallel side-by-side relationship in the compartment 19 resting on support platform 17 and snugly engaged between the upper edges of sidewalls 12, 13 of base 11. The forward ends of sharpening rods 20, 21 rest against upwardly extended front wall 16. Sharpening rods 20, 21 are of a uniform cylindrical dimension throughout, and are constituted of abrasive material, for example, a ceramic material into which is dispersed an abrasive substance such as aluminum oxide. The diameter of the rods 20, 21 is greater than the depth that platform 17 is recessed relative to the upper edges of side walls 12, 13.

A resilient clip member 23 extends from top wall 22 to to a location over the compartment 19. Resilient spring clip 23 has an upwardly curved portion or shoulder 23A extended from the top wall 22, and then a downwardly turned tongue 23B resiliently bears upon the upper portions of the sharpening rods 20, 21 to assist holding them in place with respect to compartment 19.

In use of the sharpening apparatus 10 in the mode of operation shown in FIG. 1, the rods 20, 21 are in the storage location in compartment 19 with upper forward extremities exposed. The rods are held relatively snugly in place between the sidewalls 12, 13 and by the tongue 23B of resilient clip 23. In this orientation, pointed objects can be sharpened such as the dart 25 having a pointed tip 26. Sides of the cylindrical rods 20, 21 are interfacing and preferably in linear contact forming a V-shaped crotch or trough and is sharpened as it is moved. The point 26 can be rotated as it is drawn along the rods 20, 21. Other pointed structures can be sharpened by sharpening apparatus 10 in the mode of operation or configuration shown in FIG. 1 such as hunting arrowheads. Hypodermic needles of the type used for innoculation of cattle can be sharpened as well as other pointed objects. The rods can be periodically rotated for uniform wear.

Figure 3:
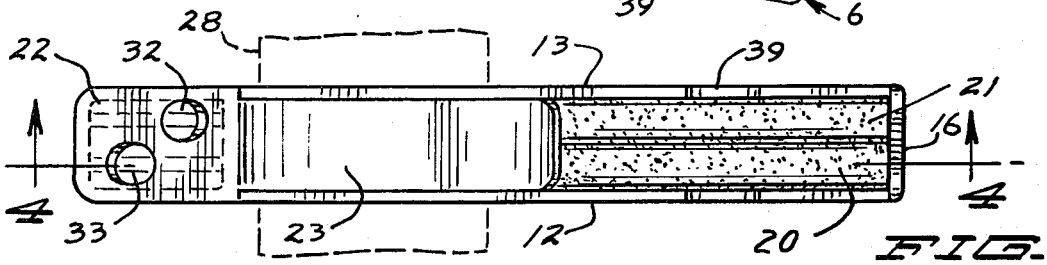
FIG. 3 is a top plan view of the sharpening apparatus of FIG. 1.

As shown in FIG. 3, spring clip 23 can be slipped over a belt indicated in phantom at 28 such that sharpening apparatus 10 is easily carried from place to place on the belt of an user. The belt 28 is slipped between the spring clip 23 and the top surfaces of sharpening rods 20, 21 situated entirely within the compartment 19.

Figure 2:
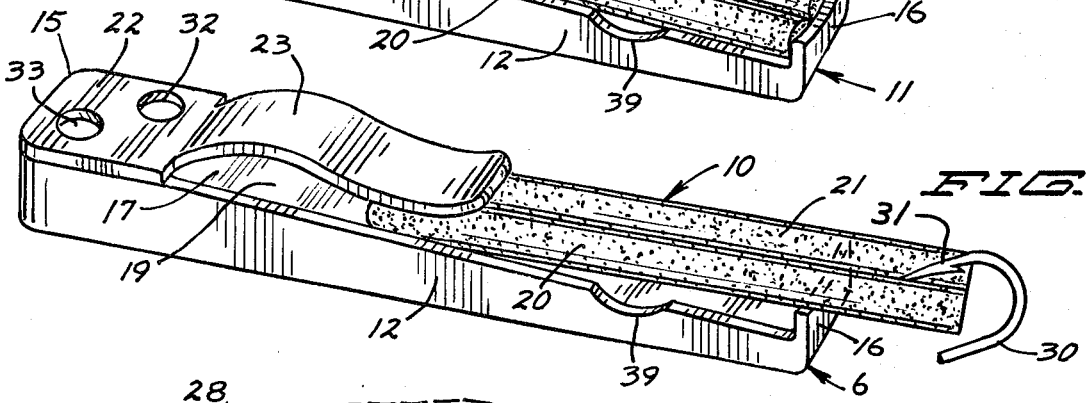
FIG. 2 is a perspective view of a sharpening apparatus according to the invention with the sharpening rods thereof positioned in a second position with respect to the base and with a fish hook positioned relative thereto for sharpening purposes.

A second mode of operation of sharpening apparatus 10 is shown in FIG. 2. The sharpening rods 20, 21 remain in parallel side-by-side relationship having their respective ends aligned. However, the rods 20, 21 are moved ahead and the forward ends thereof extend outwardly from the front wall 16 in cantilever type fashion. The opposite ends of the sharpening rods 20, 21 are situated under the spring clip 23. The upper edge 16A of front wall 16 is downwardly curved or concave to form a cradle to assist in holding the sharpening rods 29, 21 together with adjacent sidewalls in linear contact. Spring clip 23 and the downwardly curved upper edge 16A of front wall 16 are effective to hold the sharpening rods together. In this mode of operation, the ends of rods 20, 21 extended from base 11 are more accessible whereby pointed objects of a more diverse configuration can be sharpened. For example, as shown, a fishing hook 30 having a curved end portion terminating in a hook 31 can be sharpened by running the interior portion of the hook 31 back and forth along the trough 27 formed between the sharpening rods 20, 21. In the mode of operation shown in FIG. 2, the rods 20, 21 can also be rotated periodically about their respective axis to obtain uniform wear.

Figure 6:
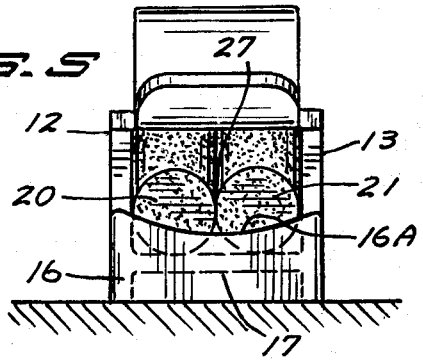
FIG. 6 is a side elevational view of the sharpening apparatus of the invention with the sharpening rods positioned in a third position with respect to the base.

A third mode of operation of sharpening apparatus 10 is shown in FIG. 6 and indicated in phantom in FIG. 4. Top wall 15 has first and second closely spaced angularly inclined cylindrical mounting openings 32, 33 having axes and edges inclined at about 20 degrees from the vertical in opposite directions to one another. Cylindrical openings 32, 33 are of a diameter to closely accept ends of the first and second sharpening rods 20, 21. In the third mode of operation, ends of the first and second sharpening rods 20, 21 are inserted in the cylindrical openings 32, 33 such that the rods themselves extend upwardly from base 11 and are oriented in angular relationship of about 20 degrees off vertical in opposite directions from one another. The fit of the rods in the cylindrical opening is snug, but is such that the rods can be easily rotated and can be easily removed to be replaced in compartment 19. In this orientation, the lower ends of the rods are adjacent one another and the rods extend away from one another angularly upwards such that the upper ends of the rods are spaced apart. The forward portion of base 11 is available to be held securely by a hand with respect to a supporting surface 35 such as a table top. A knife, having a blade such as shown at 36 in FIG. 6, is situated so that the blade is in perpendicular relationship with the longitudinal axis of the base or orientated in a vertically downward position. The cutting edge 26A of the blade 36 is initially in contact with an upper portion of one of the rods, for example the rod 20. Maintaining this perpendicular relationship with respect to the base, the blade is moved downwardly into the sharpening rod and the knife is moved longitudinally at the same time so that the point of contact moves down the rod 20 and from adjacent the handle to adjacent the tip of the knife. This action is then repeated with the other side of the knife blade 36 being initially put into contact with the other rod 21, and the longitudinal movement of the knife blade again accompanies the downward cutting action of the blade against the sharpening rod 21. This action is repeated on the left and right side of the knife blade until the blade is sharpened.

There can also be provided a third cylindrical opening 37 located in platform 17 having an axis inclined at approximately 20 degrees with respect to the vertical and in a direction toward the first cylindrical opening 32 but substantially spaced from it. One of the rods 21 can have an end inserted in the third cylindrical opening 37 such that the rod axis extends upwardly in an angle approximately 20 degrees with respect to the vertical end toward the upper end of the first rod 20 situated in the first cylindrical opening 32. This configuration, the lower ends of the rods are in spaced relationship while the upper ends are in proximate adjacent relationship. In this form of the invention, the action in sharpening a knife blade or any other approximate blade is exactly the same as in the form of the invention wherein the lower ends of the rods are in closely adjacent relationship. The knife blade is drawn first along the outside edge of one of the rods as it is moved longitudinally, and then the other side of the blade is sharpened in the same fashion. When not in use, the rods are simply removed from the cylindrical openings 32, 37 and replaced in compartment 19 in the storage position shown in FIG. 1 being held therein by resiliant clip 23. Finger detents 39 can be provided in the sidewalls 12, 13 to facilitate insertion and removal of the rods 20, 21.

Figure 7:
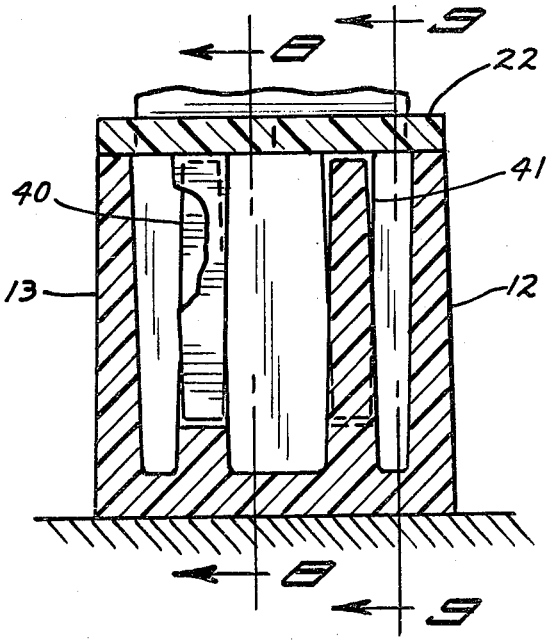
FIG. 7 is a sectional view of the sharpening apparatus as shown in FIG. 4 taken along the line 7—7 thereof.
Figure 8:
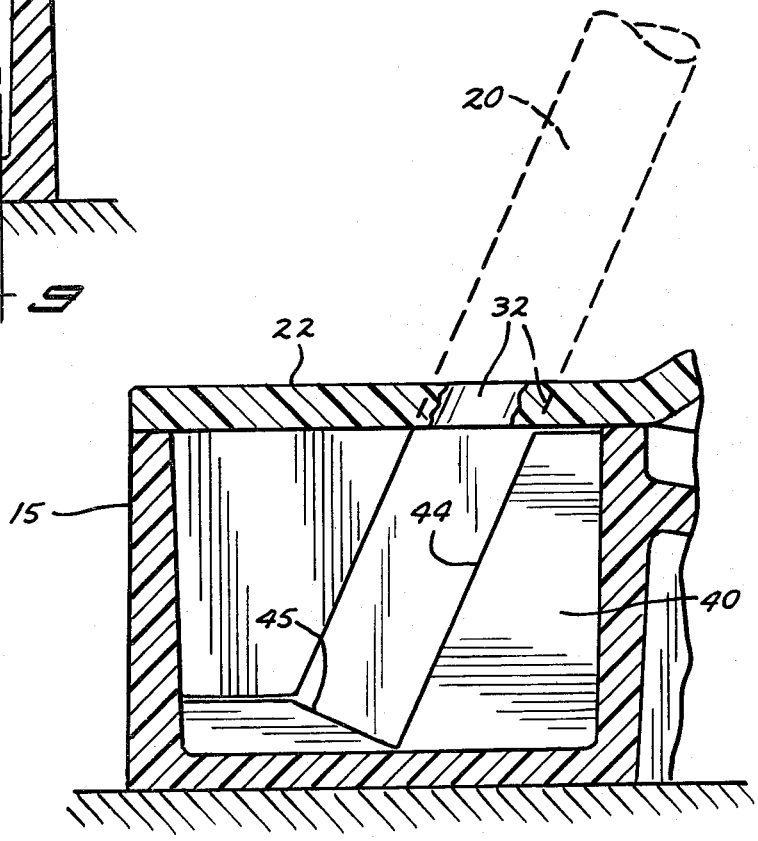
FIG. 8 is a sectional view of a portion of the sharpening apparatus as shown in FIG. 7 taken along the line 8—8 thereof.
Figure 9:
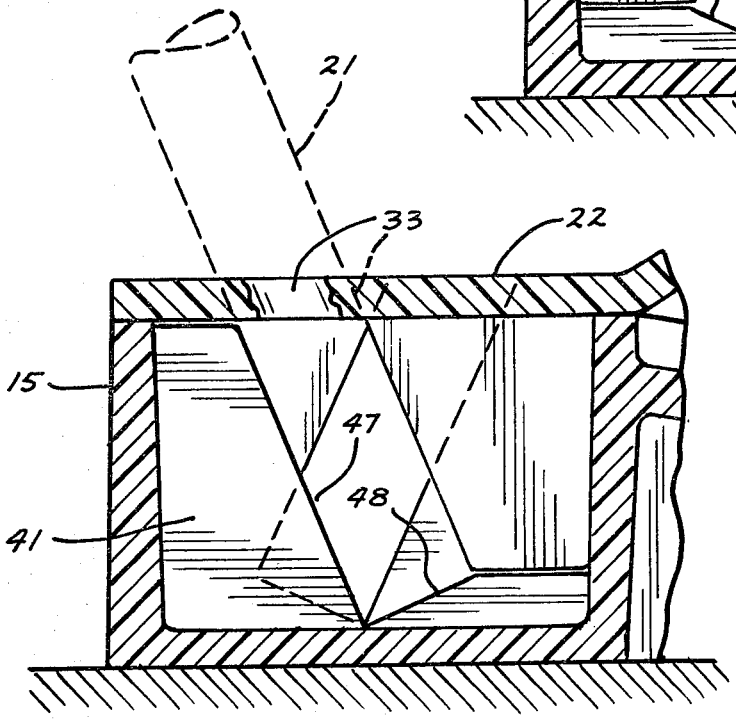
FIG. 9 is a sectional view of a portion of the sharpening apparatus as shown in FIG. 7 taken along the line 9—9 thereof.

Means are provided for additional support for sharpening rods 20, 21 when mounted in mounting holes 32, 33 in the third configuration. As shown in FIG. 7, a pair of vertical support ribs or walls extend from under top wall 22 downwardly in parallel relationship to side walls 12, 13 to the support surface 35. First support rib 40 is located beneath the first mounting hole 32. As shown in FIG. 8, first support rib 40 has a cut-out portion beneath the first mounting hole 32 comprised of an inclined edge 44 in alignment with the forward inclined edge of mounting hole 32. A bottom edge 45 extends perpendicularly from the inclined edge 44. Mounting rod 20 when mounted in the mounting hole 32 has a lower portion resting against inclined edge 44. The bottom of mounting rod 20 rests on bottom edge 45 of support rib 40.

In similar fashion, support rib 41 is located beneath the second mounting hole 32 and has a cut-out portion defined by an inclined edge 47. Inclined edge 47 is an alignment with the rear inclined edge of mounting hole 32. A bottom edge 48 extends perpendicularly from the inclined edge 47 to serve as a floor or bottom support for the second mounting hole 33, the second mounting rod 21 has a lower portion in resting engagement with the inclined edge 47. The bottom of the mounting rod 21 is supported by bottom edge 48. A greater degree of stability is thus imparted to the first and second sharpening rods 20, 21.

I claim:

1. A sharpening apparatus comprising;

a base;

a pair of thin, elongate sharpening rods;

said base having a compartment for storage of the rods in side-by-side relationship in a first position with a surface interface of the rods accesible for sharpening a pointed object;

clip means holding the rods in the compartment;

said base having an end wall partially defining said compartment;

said rods movable to a second position in side-by-side relationship with first ends located in the compartment and retained therein by the clip means, and opposite ends extended over the end wall in cantilever fashion and accessible for use in sharpening pointed articles;

said base having angularly inclined mounting openings for mounting the rods in a third position extended angularly upward in acute angular relationship to the base with each rod leaning in an opposite direction relative to the base.

2. The sharpening apparatus of claim 1 wherein: said end wall is concave to form a cradle for holding the rods in the second position.

3. The sharpening apparatus of claim 1 or 2 wherein: the mounting openings are positioned adjacent one another whereby in the third position the lower ends of the rods are adjacent one another and the rods extend away from one another angularly upward such that the upper ends of the rods are spaced apart.

4. The sharpening apparatus of claim 3 including: a third mounting opening in said base spaced from the first and second mounting openings and inclined to hold a sharpening rod in angular orientation with respect to the base extending upwardly and toward the first and second mounting openings.

5. The sharpening apparatus of claim 1 wherein: said base includes a top wall, said mounting openings are cylindrical mounting openings located in the top wall at an inclination from the vertical, said lower ends of the rods being inserted in the mounting openings so as to be upwardly extended and orientated at an acute angle relative to the base, support means for said rods located beneath the openings comprised as a support rib located beneath each mounting opening, each support rib having a cut-out portion comprised of an inclined edge inclined with respect to the inclination of a cylindrical opening, and a bottom edge at perpendicular orientation relative to the inclined edge in position to accept the bottom of a rod inserted in the cylindrical mounting opening.

6. The sharpening apparatus of claim 1 or 5 wherein: said clip means includes a resiliant spring clip extended from said top wall over the compartment of the base in having a portion in resiliant contact with the sharpening rods.

7. A sharpening apparatus comprising:

an elongate base having side walls and end walls associated with the side walls;

a support platform bounded by said side walls and a first end wall and recessed relative to edges of the side walls and said first end wall to form an open compartment;

a pair of elongate generally cylindrical sharpening rods locatable in parallel side-by-side relationship within the compartment in a first position with interfacing surfaces accessible for sharpening a pointed object;

top wall assembled at one end of base to edges of the second end wall and adjacent edges of the side walls, a clip member extending from said top wall to a position over the compartment to resiliantly hold the sharpening rods in the first position;

said rods movable to a second position in side-by-side parallel relationship with first ends located in the compartment and retained therein by the clip member, and opposite ends extended over the first end wall in cantilever fashion and accessible for use in sharpening a pointed object;

said top wall having cylindrical mounting openings for mounting the rods in a third position extended angularly away from said base in acute angular relationship with each rod extended in a opposite angular direction relative to the base.

8. The sharpening apparatus of claim 7 wherein: said first end wall is concave to form a cradle for holding the rods in the second position.

9. The sharpening apparatus of claim 7 or 8 wherein: the cylindrical mounting openings are positioned adjacent one another whereby the lower ends of the rods are adjacent one another and the rods extend away from one another angularly away from the base such that the outward ends of the rods are spaced apart.

10. The sharpening apparatus of claim 7 wherein: said base is horizontally disposed, said side walls have upper edges that slope gradually downward from proximate the second end wall toward the first end wall, said platform also sloping downward from position on the base near the second end wall toward the first end wall, the upper edge of said first end wall being located above adjacent edges of the side walls and having a concave surface for holding the rods in the second position.

11. The sharpening apparatus of claim 7 or 10 including: support ribs located beneath the top wall, one support rib located beneath each mounting hole to give support to a rod located in the mounting hole, each support rib having a cutout portion comprised of an inclined edge inclined with respect to the inclination of the cylindrical opening, and a bottom edge at perpendicular orientation relative to the inclined edge in position to accept the bottom of a rod inserted in the mounting opening.

* * * * *

UNITED STATES PATENT AND TRADEMARK OFFICE

CERTIFICATE OF CORRECTION

PATENT NO. : 4,272,925

DATED : June 16, 1981

INVENTOR(S) : Louis N. Graves

It is certified that error appears in the above-identified patent and that said Letters Patent are hereby corrected as shown below:

Column 1, line 66, after "third" insert -- working --.

Column 3, line 22, "29" should be -- 20 --.

Signed and Sealed this

*Twenty-first* Day of *September 1982*

[SEAL]

*Attest:*

GERALD J. MOSSINGHOFF

*Attesting Officer*

*Commissioner of Patents and Trademarks*